United States Patent [19]

Napolitano

[11] Patent Number: 4,494,560

[45] Date of Patent: Jan. 22, 1985

[54] SELF-PRIMING SYSTEM FOR LIQUID PUMPS

[75] Inventor: Pellegrino E. Napolitano, Middletown, N.J.

[73] Assignee: Hudson Engineering Company, Bayonne, N.J.

[21] Appl. No.: 448,258

[22] Filed: Dec. 9, 1982

[51] Int. Cl.[3] ..... F01B 25/00

[52] U.S. Cl. ..... 137/117; 251/63.5; 415/11

[58] Field of Search ..... 415/11; 417/299; 137/117; 251/63.5

[56] References Cited

U.S. PATENT DOCUMENTS

| | | | |
|---|---|---|---|
| 1,206,385 | 11/1916 | Sperry | 415/11 |
| 1,757,576 | 5/1930 | Kirgan | 415/11 |
| 3,370,604 | 2/1968 | Napolitano | 137/117 |
| 3,381,618 | 5/1968 | Napolitano | 415/11 |
| 3,451,417 | 6/1969 | Napolitano | 137/117 |
| 4,335,744 | 6/1982 | Bey | 251/63.5 X |

*Primary Examiner*—Robert G. Nilson

*Attorney, Agent, or Firm*—Fleit, Jacobson, Cohn & Price

[57] ABSTRACT

A self-priming pump system incorporating a priming valve to release a quantity of priming liquid upon loss of pump suction. The valve includes a piston connected to a valve member, the piston having an area greater than that of the valve member. Discharge line static pressure act upon the valve member and the piston and the difference in area results in a net force tending to open the valve. The valve is maintained closed by the pump discharge dynamic pressure acting through a conduit and upon the opposite face of the piston. The valve does not include any springs or other mechanical biasing means.

9 Claims, 2 Drawing Figures

SELF-PRIMING SYSTEM FOR LIQUID PUMPS

BACKGROUND OF THE INVENTION

This invention relates to self-priming vertical pump systems and more particularly to an improved priming valve structure suitable for use in a self-priming vertical liquid pump system.

Self-priming liquid pumping systems are known, and an example of a widely used system of that type is illustrated in U.S. Pat. No. 3,370,604, which is owned in common by the assignee of the present invention. As there shown, a pump is positioned so that its suction inlet line is submerged in a suction chamber and the discharge line from the pump includes a check valve to prevent reverse flow through the discharge line back to the pump when suction is lost. A priming valve is positioned in the discharge line between the pump discharge and the check valve. The column of liquid between the priming valve and the check valve serves as the priming liquid, and the flow thereof back to the suction chamber is controlled by the priming valve. Heretofore, the priming valve structure in most common use was a spring-biased, poppet-type valve to which a suitable piston was secured in order to permit control of the priming valve by means of pressure from the pump discharge, which is conveyed through a conduit that extends into the discharge stream to sense the loss of priming by means of the decrease in pump output flow. The structure arrangement as briefly described hereinabove is somewhat complicated, and it is desirable to provide a system having a simpler structure in order both to facilitate manufacture and to minimize operational problems.

SUMMARY OF THE INVENTION

It is an object of the present invention to provide a self-priming system for liquid pumps wherein a priming valve is provided which does not rely upon internal springs for its operation.

It is another object of the present invention to provide a self-priming system for liquid pumps wherein the valve is operated solely by the various pressures existing within the system.

It is still another object of the present invention to provide a self-priming system for liquid pumps wherein it is not necessary to use venturis or other dynamic head or flow sensing devices which extend into the flow stream.

Briefly stated, in accordance with one aspect of the present invention, an improved valve is provided for a self-priming system for liquid pumps. The valve includes a cylindrical housing having one end positioned in communication with the discharge line of the pump. At least one discharge aperture is provided in the housing and positioned intermediate the ends thereof, the discharge aperture being in communication with the suction chamber, from which the liquid pump draws the liquid which is to be conveyed, and with a valve seat. A valve member is slidable in order to selectively close and open a flow path through the valve seat, the valve seat positioned at an opening in the discharge line in order to permit flow therefrom to the suction chamber through the discharge aperture when the valve is open.

The valve member has an area which is exposed to the static liquid pressure in the discharge line, and also includes a piston connected to and spaced from the valve member. A cylinder is connected to the valve body outwardly of the discharge column to slidably receive the piston, the piston having a first face and a second face. A conduit extends from the discharge of the pump to the cylinder to convey pump discharge dynamic pressure to the first face of the piston, and a second conduit extends from the discharge line downstream of the pump to the cylinder to convey discharge line static pressure to the second face of the piston.

During normal operation of the pump the liquid static pressure acting on the valve member and the liquid dynamic pressure acting on the first face of the piston are sufficient to maintain the valve in the closed position. During abnormal operation of the pump, when the pump discharge dynamic pressure is diminished because of loss of pump suction, the force of the liquid static pressure against the second face of the piston is greater than the force of the liquid static pressure against the valve member to thereby cause the valve to open and permit the liquid in the discharge column to flow to the pump suction chamber and prime the pump.

DESCRIPTION OF THE PREFERRED EMBODIMENTS

Figure 1:
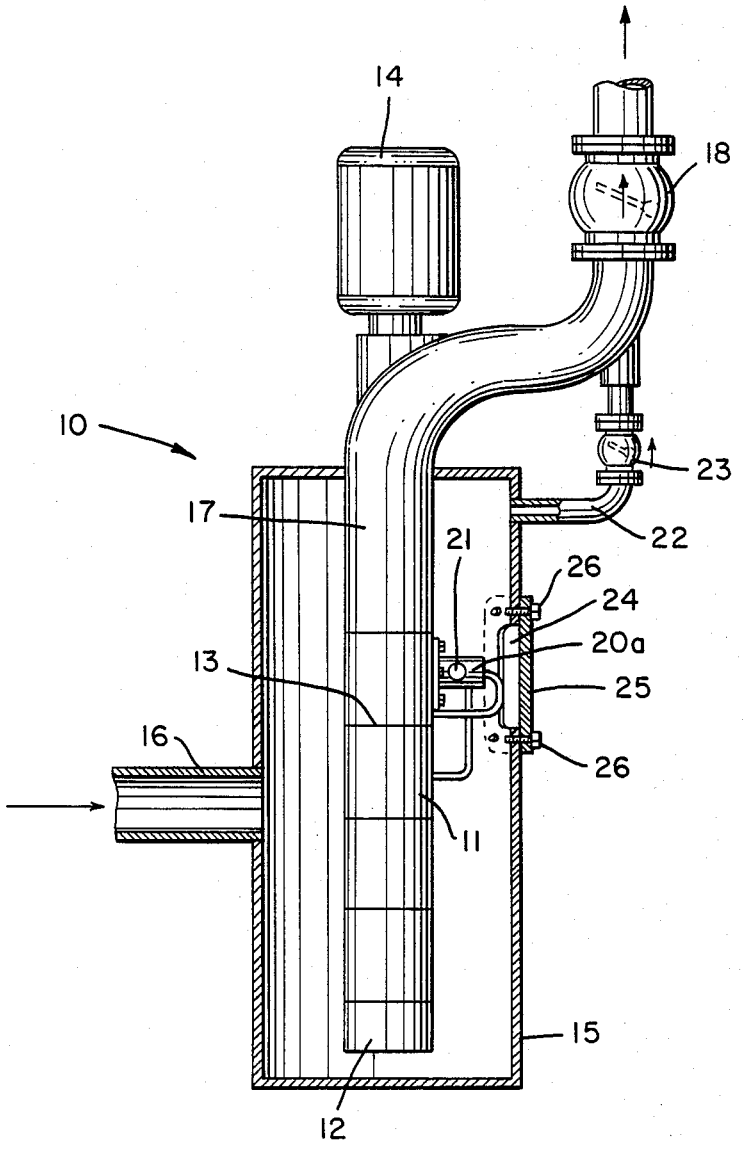
FIG. 1 is a side elevational view, partially in section, illustrating a self-priming pump system incorporating a valve structure in accordance with the present invention.

Referring now to the drawings, and particularly to FIG. 1 thereof, there is shown a portion of a fluid system 10 which includes a pump 11 having an inlet 12 and an outlet 13. Pump 11 as shown is a multi-stage, vertically positioned centrifugal pump, commonly referred to as a deep well pump, and three such stages are illustrated, but a single stage pump could also be utilized, if desired. The pump is driven by a suitable drive means, such as, for example, an electric motor 14, which is drivingly connected to the pump impeller by means of a suitable drive shaft (not shown). A suction chamber 15 is provided in the form of a closed structure which includes an inlet conduit 16 in communication with a source of liquid, which can be provided in a separate storage tank (not shown). Suction chamber 15 is maintained with sufficient liquid by virtue of the reduced pressure which occurs when the liquid therein contained is pumped therefrom, whereby atmospheric pressure acting on the surface of the liquid in the storage tank (not shown) serves to force the liquid through inlet conduit 16 and into suction chamber 15 in order to maintain suction liquid for pump 11.

Pump outlet 13 is connected to a discharge line 17 which, as shown, preferably extends in a generally vertical direction and includes a check valve 18 positioned downstream of pump 11. Positioned in discharge line 17 downstream of pump outlet 13 is a priming valve **20*a*. The volume within discharge line 17 between check valve 18 and priming valve 20*a* provides a column of liquid which is of a sufficient quantity to permit priming of the pump. Priming valve 20*a* includes at least one outlet opening 21 to permit priming liquid from discharge line 17 to pass into suction chamber 15 to prime pump 11**.

A relief conduit 22 extends from the top of suction chamber 15 to discharge line 17 upstream of check valve 18 to permit expulsion of air previously drawn into the upper portion of suction chamber 15. A relief check valve 23 is provided in relief conduit 22 to allow fluid movement only in a direction toward discharge line 17 and serves to prevent liquid in discharge line 17 from returning to suction chamber 15 by means of conduit 22. When the pump loses its prime, it is because the liquid in the suction tank 15 is exhausted and is replaced by air or vapor. Full flow cannot be established within the system until and unless the air within the suction tank is expelled and replaced by liquid. Whereas conduit 22 does conduct the air from tank 15 to discharge conduit 17 through check valve 23, it does not constitute a means of escape but rather it provides a transfer means; for when the liquid in discharge conduit 17, between check valve 18 and priming valve 20*a* begins to return to tank 15, because a flow path has been provided through the opening of valve 20*a*, a vacuum will be created between the liquid column in discharge conduit 17 and check valve 18. The dropping of the liquid level in conduit 17 causes air in tank 15 to be drawn up through relief conduit 22 and check valve 23 to replace the volume of liquid. When the total transfer of the controlled volume of liquid and air has taken place there will be enough liquid in tank 15 to reach the pump's impeller eye and the pump will be in primed pumping mode. The air that was contained within the discharge conduit cannot return to tank 15, because of check valve 23, and is therefore forced through check valve 18 and expelled from the system by the liquid piston caused by the pumpage in conduit 17.

Also positioned in suction chamber 15 is an access opening 24 provided with a removable cover plate 25, which is secured with bolts 26 to suction chamber 15 in fluid-tight relationship therewith and in a position substantially opposite priming valve 20*a*. The purpose of opening 24 is to facilitate access to priming valve 20*a* and thereby permit servicing thereof, as necessary.

Figure 2:
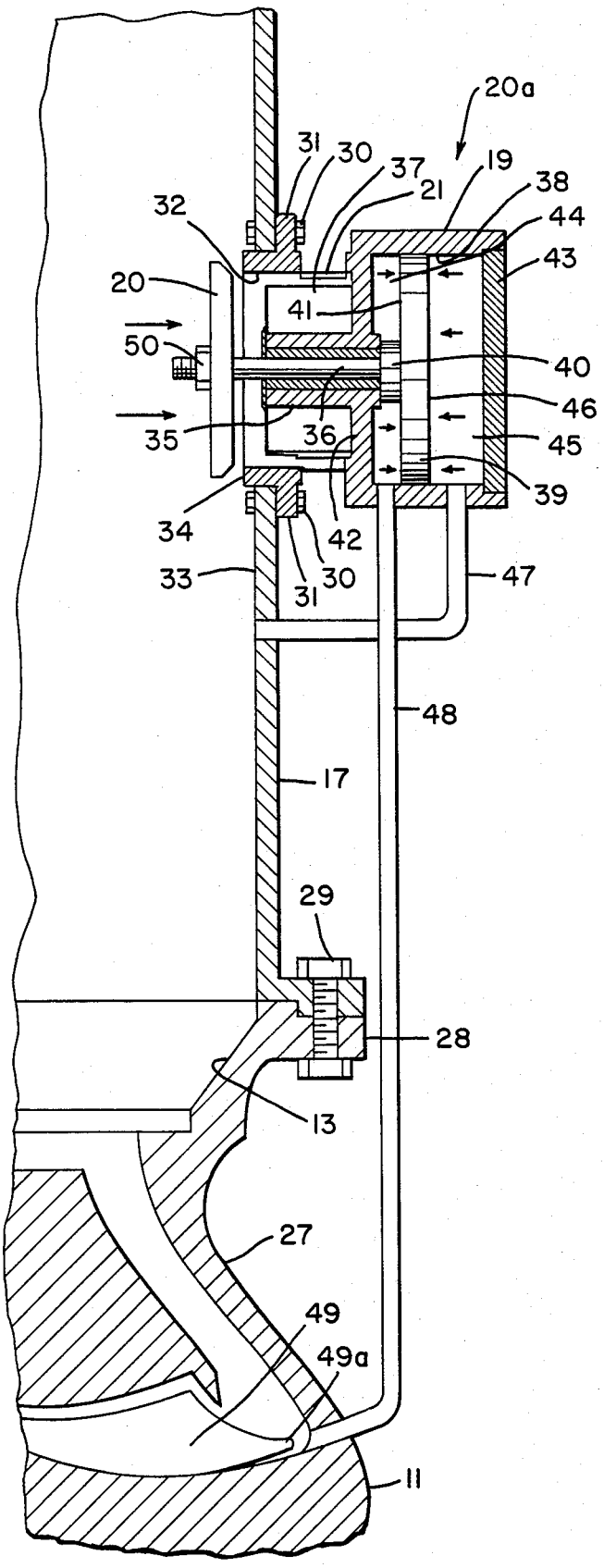
FIG. 2 is a fragmentary cross-sectional view of one embodiment of a priming valve in accordance with the present invention.

Referring now to FIG. 2, there is shown a portion of the outlet stage 27 of a multi-stage centrifugal pump 11. Pump outlet 13 is connected to discharge line 17 by means of a flanged connection 28 which can be secured by bolts 29, or the like. Positioned downstream of pump outlet 13 is priming valve 20*a* which includes a housing 19 secured to a suitable opening in discharge line 17 by means of bolts 30 which interconnect a flanged portion 31 of housing 19 with discharge line 17.

Valve housing 19 is of generally cylindrical cross section and includes an inner opening 32 which is adjacent the interior surface 33 of discharge line 17, and which terminates in an inwardly facing valve seat 34. An intermediate portion of valve housing 19 includes a central, inner sleeve 35 to slidably receive a rod 36. Sleeve 35 is secured within housing 19 by means of a plurality of radially-directed supporting struts 37 having outlet openings 21 therebetween to permit liquid flow through the outer wall of housing 19 and into suction chamber 15.

Positioned outwardly of inner sleeve 35 is a cylinder 38 which has an inner cross-sectional area greater than the effective area of priming valve poppet 20. Slidably received within cylinder 38 is a piston 39 which includes an inwardly directed abutment 40 on its inner cylindrical bore having a face 41, and which is adapted for contact with the outer end of inner sleeve 35 in order to limit the axial movement of piston 39 in a direction toward discharge line 17. Rod 36 is suitably secured at one end to abutment 40 of piston 39, or it can be integral therewith. The other end thereof is threaded and is secured by means of threaded nut 50 to valve poppet 20, which is movable relative to valve seat 34 in order to selectively open and close inner opening 32. Cylinder 38 includes an inner end wall 42 to which sleeve 35 is secured. An outer end cap 43 is provided to close cylinder 38 and can be secured thereto in any convenient manner. Thus a first chamber 44 is provided between cylinder inner end wall 42 and piston inner face 41, and a second chamber 45 is provided between outer end cap 43 and piston outer face 46.

A static pressure conduit 47 is provided to permit communication between second chamber 45 and discharge line 17 to permit the static pressure of the liquid in discharge line 17 to enter second chamber 45 and to act against outer face 46 of piston 39 and thereby exert a force thereon tending to urge piston 39 inwardly toward sleeve 35.

A total pressure conduit 48 is positioned between first chamber 44 and pump 11 at a point substantially radially outwardly of impeller 49 to permit liquid pressure from the pump adjacent the edge 49*a* of impeller 49 to enter first chamber 44 and act against inner face 41 of piston 39 in a manner to urge it in an outward direction, away from sleeve 35. A pressure gradient exists vertically across edge 49*a* of impeller 49. Pressure conduit 48 is positioned opposite edge 49*a* at a point where there is a substantial reduction in total fluid pressure when there is a loss of liquid at the impeller inlet.

In operation, when pump 11 is pumping liquid through outlet 13 and into discharge line 17, check valve 18 is open and liquid flows therethrough. The liquid within discharge line 17 exerts static pressure against the face of valve poppet 20, resulting in a force which urges it into contact with valve seat 34. That same static pressure within discharge line 17 is also communicated through conduit 47 to outer face 46 of piston 39, which results in a force thereon in an inward direction relative to discharge line 17 and which is greater than the force tending to seat valve poppet 20 because the piston area is greater than the effective area of the face of valve poppet 20. However, acting on inner face 41 of piston 39 is the liquid total pressure adjacent edge 49*a* of impeller 49, which is communicated to first chamber 44 by means of conduit 48, resulting in a force on piston 39 which acts in the same direction as the static pressure force acting on valve poppet 20. The combination of the latter two forces is sufficient to overcome the valve opening force exerted in second chamber 45 against outer face 46 of piston 39, with the result that valve poppet 20 is in the closed position relative to valve seat 34.

When for one reason or another suction at inlet 12 to pump 11 is lost because of insufficient priming liquid in suction chamber 15, that fact will be reflected in pressure conduit 48 because total fluid pressure at edge 49*a* of impeller 49 at the point of entry into conduit 48, will substantially drop, as will the total fluid pressure in chamber 44. Because no flow is taking place, discharge check valve 18 will close preventing reverse flow therethrough. The column of liquid within discharge line 17 between check valve 18 and pump outlet 13 exerts a static pressure against the effective sealing area of priming valve poppet 20 tending to urge it into a closed position relative to valve seat 34. However, that same static pressure head is also communicated through conduit 47 to second chamber 45 and acts on the larger area of piston 39 to result in a force which is greater than the closing force acting on valve poppet 20. Therefore, piston 39 is urged toward discharge line 17, moving valve poppet 20 into the open position relative to valve seat 34, and permitting the liquid in discharge line 17 to flow through open valve poppet 20 and opening 21 into suction chamber 15, to prime pump 11. As the liquid from discharge column 17 flows into suction tank 15 it is replaced by air drawn from suction tank 15 through relief line 22 and check valve 23. When flow through pump 11 has been restored, the fluid pressures in the system are such that valve poppet 20 returns to its closed condition, as hereinbefore described.

It can thus be seen that the present invention provides an improved priming valve structure in that the valve is of greatly simplified construction by virtue of the absence therefrom of any springs or other biasing means, the valve being operable solely by the various pressures within the liquid system. Additionally, because the dynamic pressure is sensed at the outer edge of the impeller of the pump, and does not involve the sensing of discharge column dynamic pressure by way of interposing a venturi, a pitot tube, or the like, there is significantly less flow resistance presented at the pump outlet, thereby increasing the effective performance of the entire system.

While particular embodiments of the present invention have been illustrated and described, it will be apparent to those skilled in the art that various changes and modifications can be made without departing from the spirit and scope of the present invention, and it is intended to encompass within the appended claims all such changes and modifications which fall within the scope of the present invention.

What is claimed is:

1. In a self-priming pump system for a vertical pump having an inlet and an outlet, a suction chamber for the liquid to be pumped, the suction chamber being in communication with the pump inlet, a discharge line connected to the pump outlet, a check valve positioned in the discharge line downstream of the pump outlet a distance sufficient to provide a column of priming liquid for priming the pump upon loss of suction at the pump inlet, and a priming valve having an inlet in communication with the discharge line and an outlet in communication with the suction chamber and positioned in the discharge line between the pump outlet and the check valve, the priming valve responsive to liquid flow from the pump to automatically permit flow of the priming column of liquid from the discharge line to the suction chamber under predetermined flow conditions, the improvement comprising:

said priming valve having a valve member and a valve seat positioned adjacent an opening in said discharge line to permit flow therethrough when said valve member is spaced from said valve seat, and to prevent flow therethrough when said valve member is against said valve seat, said valve member having an area exposed to the static fluid pressure in said discharge line, a piston connected to and spaced from said valve member, a cylinder connected to said valve body outwardly of said discharge column to slidably receive said piston, said piston having a first face and a second face, a conduit extending from the discharge of said pump to said cylinder to convey pump discharge dynamic pressure to said first face of said piston, a conduit extending from said discharge line to said cylinder to convey discharge line static pressure to said second face of said piston, whereby upon normal operation of said pump the liquid static pressure acting on said valve member and the liquid dynamic pressure acting on said first face of said piston are sufficient to maintain said valve in the closed position, and upon cessation of flow through said pump when the pump discharge dynamic pressure is diminished because of loss of pump suction, the force of the liquid static pressure against said second face of said piston is greater than the force of the liquid static pressure against said valve member to cause said valve to open and thereby permit the liquid in said discharge column to flow to the pump suction chamber and prime the pump.

2. The self-priming pump system of claim 1 wherein said pump discharge pressure is provided by a dynamic pressure conduit which extends from the outlet stage of said pump to said first piston chamber.

3. The self-priming pump system of claim 2 wherein said pump includes a rotatable impeller and said dynamic pressure conduit is positioned opposite the edge of said impeller at a point where there is a substantial reduction in total fluid pressure when there is a loss of liquid at the impeller inlet.

4. The self-priming pump system of claim 2 wherein said dynamic pressure conduit is positioned substantially radially outwardly of the outlet stage of a multistage, centrifugal flow pump.

5. The self-priming pump system of claim 1 wherein said valve is a poppet valve connected to said piston by means of a rod slidably received in a sleeve supported within said housing, said valve having a face exposed to the fluid in said discharge column and cooperable with said valve seat to selectively prevent and permit flow to and from said discharge column.

6. The self-priming pump system of claim 4 wherein said valve includes an elongated support spider for said connecting rod connecting said valve poppet and said piston.

7. For use in a self-priming pump system, a priming valve comprising a housing, a valve member and a valve seat carried by said housing to permit flow therethrough when said valve member is spaced from said valve seat, and to prevent flow therethrough when said valve member is against said valve seat, a piston connected to and spaced from said valve member, a cylindrical bore within said housing to slidably receive said piston, said piston having a first face and a second face, means for connecting a first, total pressure conduit to said cylindrical bore to provide communication with said first face of said piston, means for connecting a second, static pressure conduit to said cylindrical bore to provide communication with said second face of said piston, whereby the force resulting from a liquid static pressure acting on said valve member and a liquid total pressure acting on said first face of said piston are sufficient to maintain said valve in the closed position against the opposite force resulting from static pressure acting on said second face of said piston, in a first mode of operation and the force resulting from liquid static pressure acting on said second face of said piston is greater than the force resulting from the liquid static pressure acting against said valve member and the force resulting from the liquid total pressure acting on said first face of said piston in a second mode of operation to cause said valve to open and thereby permit flow therethrough.

8. The priming valve of claim 7 wherein said valve member is a poppet valve connected to said piston by means of a rod slidably received in a sleeve supported by said housing, said valve member having an outwardly directed face adapted to be exposed to the fluid in a conduit.

9. The priming valve of claim 8 wherein said housing includes an elongated support spider for said connecting rod connecting said valve poppet and said piston.

* * * * *